United States Patent [19]

McGee et al.

[11] Patent Number: 4,646,662

[45] Date of Patent: Mar. 3, 1987

[54] OVERFEED STOKER

[75] Inventors: Peter C. McGee, R.D. #1, P.O. Box 196, McGees Mills, Pa. 15757; Herman O. Beck, Burnside, Pa.

[73] Assignee: Peter C. McGee, McGees Mills, Pa.

[21] Appl. No.: 735,877

[22] Filed: May 20, 1985

[51] Int. Cl.[4] ..... F23K 3/18

[52] U.S. Cl. ..... 110/289; 241/600

[58] Field of Search ..... 110/267, 289–293, 110/109, 114; 241/101.5, 600, 283, 33; 221/271, 273, 276; 222/340, 341, 409

[56] References Cited

U.S. PATENT DOCUMENTS

| | | |
|---|---|---|
| 913,771 | 3/1909 | Roe . |
| 1,177,430 | 3/1916 | Metesser . |
| 1,605,665 | 11/1926 | Riley et al. . |
| 1,694,290 | 12/1928 | St. Clair . |
| 1,736,565 | 11/1929 | Woodcock . |
| 1,938,681 | 12/1933 | Beers . |
| 2,097,564 | 11/1937 | Durand . |
| 2,105,988 | 1/1938 | Ridet . |
| 2,276,659 | 3/1942 | Kreisinger . |
| 2,454,400 | 11/1948 | Norman . |

*Primary Examiner*—Mark Rosenbaum

*Attorney, Agent, or Firm*—Steele, Gould & Fried

[57] ABSTRACT

A fuel stoker for removable attachment to the access port of a solid fuel furnace has a bin for receiving fuel such as coal and a chamber carrying a piston, located at the bottom of the bin, for periodically throwing a charge of coal on top of a fire. A spring-loaded bar, pivotable by one end on the bin, is connected to the piston via a linkage, and spring-biased to advance the piston towards the fire. A spiral cam having a sudden drop-off is intermittently rotated one revolution by a motor to retract the piston and allow fuel to drop into the chamber. At the drop-off, the piston is suddenly advanced to throw the fuel onto the fire. The drive shaft also operates an agitating poker and a grate shaker during the fuel loading phase of operation.

18 Claims, 5 Drawing Figures

OVERFEED STOKER

BACKGROUND OF THE INVENTION

1. Field of the Invention

This invention relates to the field of automatic solid fuel stokers, and especially to a detachable overfeed fuel stoker adapted for substantially-unattended home use. The invention is particularly effective with soft, coking coal.

2. Prior Art

A number of devices are known in the art in which a rotational element such as a motor is connected by means of a linkage to a reciprocating element, in order to introduce fuel into a furnace. These devices are not adapted to wind up and release a spring or to suddenly unload stored energy, to thereby throw fuel onto the surface of a fire. Instead, prior art devices slowly and continuously feed quantities of coal, toward or under the fire. Although such a mechanism is effective and useful in connection with feeding of anthracite coal (i.e. hard coal), substantial difficulties are encountered when slow motion techniques are attempted using soft coal (bituminous or coking coal). With the soft coal, heat causes softening together with release of more-or-less volatile hydrocarbons. When heated, the chunks of coal become sticky and adhere to one another in a viscous mass.

Problems with simple adherence of coal chunks could presumably be overcome by employing a sufficiently deep bed of unburned coal that the coal could be added at a relatively-cool lowermost zone where it would not adhere, and thereafter moved vertically upwards as more coal was placed below. Unfortunately, with coking coal, the upper viscous heated layer tends to choke off the flow of oxygen. Therefore, underfeed devices are not particularly useful with soft coal. There are also difficulties in small scale installations such as home furnaces in that it is impractical or dangerous to have a quantity of unburned coal under the fire. Furthermore, continuous feeding from underneath precludes the possibility of ash removal from below the area of combustion, as is preferred in connection with home furnace installations.

Automatic stokers for the addition of coal to a fire, in which a piston is employed to periodically move an incremental quantity of coal from a bin to a combustion area are shown, for example, in U.S. Pat. Nos. 913,771—Roe, 1,177,430—Metesser, 1,605,665—Riler et al, 1,694,290—St. Clair, 1,736,565—Woodcock, 1,938,681—Beers and 2,276,659—Ciersinger. These devices, although effective at unloading bins, are each prone to certain difficulties if applied to home installations or if used with coking coal. Accordingly, they are normally used only with anthracite. Pusher means in the form of spaced fuel pusher bodies are provided along a rigid connection member with a reciprocating driving means, e.g., a piston. The pusher bodies, for example, have a flat front face, for pushing the coal on the forward stroke of the connection member, and an inclined rear face, to slide past the coal on the return stroke. In some installations, such pushers take the form of a reciprocating terraced fuel support, the advance of which carries fuel from the bin to the combustion area. In other devices, the pusher is a separate element either connected to the same linkage as the piston or periodically operable in some other manner. The point of these devices is to achieve a horizontal motion of the coal, towards the side and/or bottom of a pile of burning coal.

Inasmuch as prior art stoking devices are primarily intended for relatively large scale installations, it is the exception to find a stoker mechanism which is easily removable from the furnace. Instead, other means are provided in connection with such devices for gaining access to the combustion area. This is no problem in large installations where there is room for ports for ash removal and the like. The usual home installation does not have sufficient space for various ports. Moreover, the usual port provided for the addition of fuel to a home furnace is likely to be placed in close proximity to the port provided for removal of ash such that mounting a stoker at one port tends to preclude access to the other port, and vice versa.

In U.S. Pat. No. 2,097,564—Durand, a stoker is provided with casters such that it can be wheeled up to a furnace. The Durand device has an overfeed mechanism in the form of a piston, pushing coal horizontally into a chute or trough. The chute extends right over the combustion area, terminating in a closed end whereby as the chute becomes full, pieces of fuel fall from the sides and end of the chute onto the fire below. Of course, placing a chute directly in the combustion area interferes with the flow of air. Furthermore, the chute itself is thereby heated and fuel in the chute will coke and may burn. A quantity of energy is also lost by useless conduction of heat into the stoker.

A similar device to that of Durand is shown in U.S. Pat. No. 1,694,290—St. Clair. In that patent, a caster-carried coal stoker has a tray extending into the fire chamber, the tray holding the coal at all times during combustion. When the bin is emptied, the entire mechanism, including the fuel-support means, is removed from the furnace. Both the Durand and St. Clair devices are hybrids wherein a central part of the combustion supporting structure is intimately associated with the stoker. These devices may be efficient, but they are not suitable for adapting home furnaces, which are already provided with certain attributes (e.g., dimensions and fuel support structures) that are not readily changed in the manner of Durand and St. Clair. Moreover, devices which depend on means constantly exposed to the heat of the furnace are not long-lived.

In order to provide a mechanism that will place a charge of solid fuel, especially soft coal, onto a combustion area, yet not block upward air flow in the combustion area or deteriorate rapidly in the heat and corrosive gases, the invention is adapted to throw the fuel onto the combustion area from the side. Prior art devices such as namely St. Clair and Durand, have been adapted to spill fuel onto the combustion area from a chute located over the combustion area. The other cited patents have likewise relied upon slow reciprocating elements substantially positioned in the combustion area or underfeed techniques that advance the fuel incrementally.

The present invention takes a new and more effective approach in that a means of stoking accomplishes throwing of coal from a device located entirely outside the combustion area of furnace, at the usual fuel-access port. The invention works well for sticky soft coal because the fuel is kept outside the combustion area, and thereby relatively cool (i.e., not subject to coking), until it is actually thrown onto the fire. The invention can also can be used for hard coal. A fuel poker bar intermittently run into the fire agitates the burning fuel synchronously with the drive mechanism, ensuring ready access of air to the coals. The invention does not depend upon any high powered means such as a steam blast for causing a sudden motion necessary for throwing, but instead includes a timer that intermittently activates a motor to rotate a cam shaped wind up and release a spring. Stored energy in the spring is released through a piston to fling the coal. The feed can accordingly be executed in readily-available parts, and applied as a retrofit to coal furnaces of virtually any manufacture.

SUMMARY OF THE INVENTION

It is an object of the invention to provide a fuel stoker having means for storing a supply of solid fuel of any of various types applicable generally to load such fuel into any of various types of solid fuel furnace.

It is another object of the invention to provide a stoker that allows maximum access to a furnace on which it is mounted, which can also be removed and replaced with minimum inconvenience.

It is another object of the invention to provide a durable and dependable stoker that is inexpensive but will function dependably without a great deal of attention.

It is yet another object of the invention to provide a periodic-action stoker that is subject to the control of stoking rate in order to maintain temperature.

These and other objects are accomplished by a fuel stoker for removable attachment to the access port of a solid fuel furnace having a bin for receiving fuel such as coal and a chamber carrying a piston, located at the bottom of the bin, for periodically throwing a charge of coal on top of a fire. A spring-loaded bar, pivotable by one end on the bin, is connected to the piston via a linkage, and spring-biased to advance the piston towards the fire. A spiral cam having a sudden drop-off is intermittently rotated one revolution by a motor to retract the piston against the spring bias and allow fuel to drop into the chamber. When the cam reaches a drop-off, the piston is released, whereupon the piston is advanced by the spring, throwing the fuel onto the fire. The drive shaft also operates an agitating poker and if desired a grate shaker, on each load/throw revolution.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
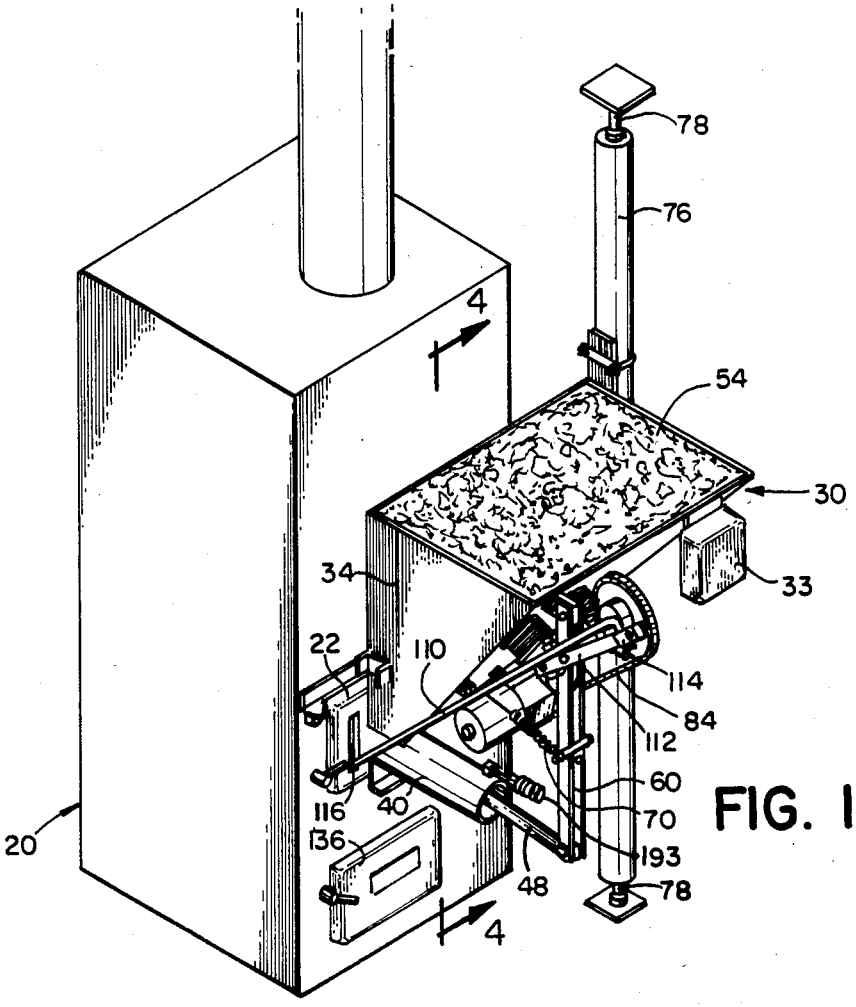
FIG. 1 is a perspective view of an installation of a stoker according to the invention on a furnace.

As illustrated in FIG. 1, the stoker of the invention is adapted for use on a relatively-small home-type furnace 20. Such home-type furnaces have an upper port 22 for loading fuel and a lower port 136 for removing ash. When conventional furnaces are manually maintained, the user opens door 22 by lifting a latch and shovels a quantity of coal onto the coals burning in the fire. The fire is expected to then burn for a period of time related to the size of load. Inasmuch as the user is required to manually load the charge of fuel, the tendency is to load an inefficiently large quantity of fuel, to avoid the inconvenience of frequent attention to the furnace. The larger quantity of fuel indeed takes a longer time to burn, however, the larger quantity causes the fuel to burn less efficiently than would occur if small quantities of fuel were added over the same period of time. Automatic stokers provide benefits in steadying fuel burning for better efficiency as well as in convenience to the user.

According to the invention, automatic stoker having bin 30 for holding a change of fuel, for example the fuel required for twenty-four hours, is affixed to furnace 20 at the upper, fuel-loading port 22. Bin 30 and its operating mechanism are locating entirely outside the furnace 20, except for an agitating poker bar 110, which is run through the fuel-burning area during cycling of the stoker, to remove ash, break up coked chunks and insure complete burning.

A basic function of the stoker of the invention is to periodically throw the charge of fuel onto the combustion area from above. This is accomplished by allowing a quantity of fuel chunks from bin 30 to accumulate by force of gravity and machine vibration in a fuel-discharging chamber 40, at the bottom of bin 30. Bin 30 may have a vertical wall 34 and also at least one sloping wall 32, to confine the lowermost part of bin 30 to the area adjacent the fuel-discharge passage against the force of a spring 40. A piston such as an end-capped pipe is movably mounted to substantially retract from chamber 40, allowing the chamber to fill up with fuel, and then to suddenly advance into chamber 40 to throw the fuel onto the fire. The sudden advance is accomplished by intermittently activating a motor turning a drive shaft having a cam of increasingly greater radius (e.g., a spiral). The cam is shaped to gradually retract the piston against the force of a spring 70, and the cam has a sudden drop-off that releases the piston, allowing spring 70 to forcefully advance the piston for throwing the fuel onto the fire. The tension of spring 70 can be adjusted by choice of the point of attachment of the ends thereof on bin 30 and/or along bar 60.

Figure 2:
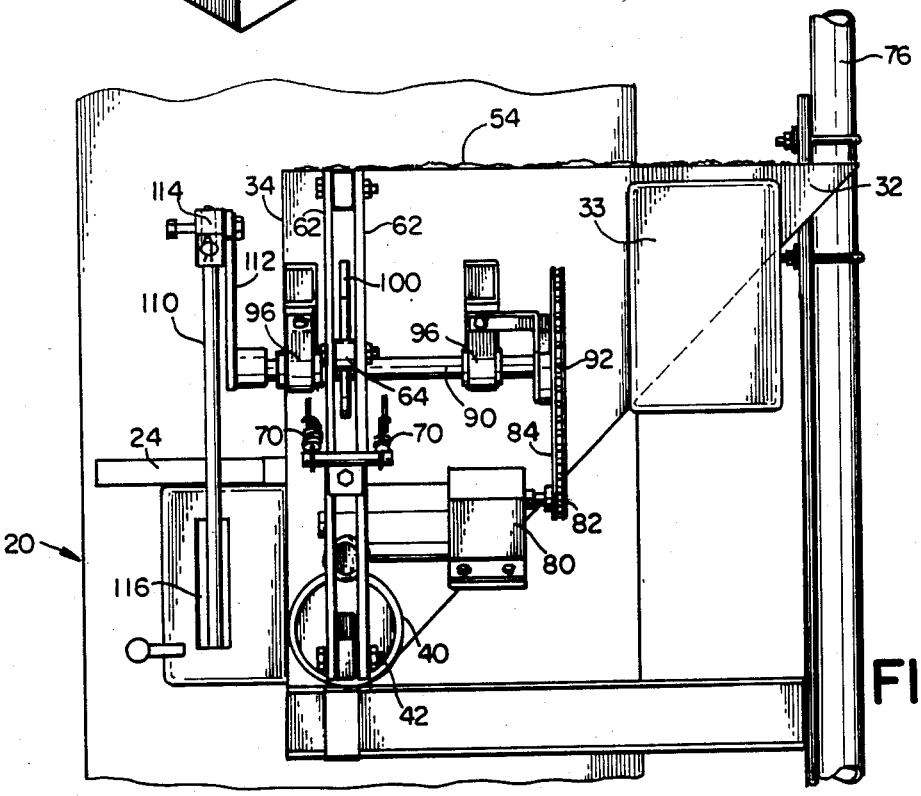
FIG. 2 is a partial elevation view of the stoker as mounted on a furnace.

FIG. 2 illustrates the stoker of FIG. 1 in elevation, looking toward the front portion of furnace 20. A motor 80 is mounted on the outer surface of the bin, preferably on the side most remote from the furnace, and thereby kept cool. Motor 80 for example may be an induction motor having a geared output to achieve one revolution in five seconds or so. A sprocket 82, affixed to the shaft of motor 80, is connected by means of a roller chain 84 to a second sprocket 92, mounted on shaft 90. Shaft 90 is rotatably mounted to the wall of bin 30 by means of pillow blocks 96. Driveshaft sprocket 92 is preferably five times larger than motor sprocket 82. Therefore, shaft 90 is geared down to rotate, for example, about one revolution per twenty-five seconds. Each revolution of shaft 90 completes a cycle, loading about a quart of coal. A timer 33 initiates a cycle at timed intervals, for example, between two and sixty cycles per hour. The rate may be subject to a manual control, or made automatic subject to a thermostat (not shown).

Drive shaft 90 has a cam 100 rigidly attached thereto. As cam 100 rotates together with shaft 90, the support bar structure 60, for example including spaced bars 62, 62, is raised from bin 30 against the tension of spring 70. Support 60 and its bars 62 are pivotally mounted to bin 30 at one end, e.g., the upper end, and pivotally mounted to piston 42 in chamber 40, at the opposite end. A roller 64 is mounted intermediate the ends of support bar 60, between spaced bars 62, 62, the roller riding against cam 100. The roller, and the piston, follow a path dependent on the contour of the cam and the speed of cam rotation. The cam is normally at rest with roller bar 64 at a point of minimum diameter. At timed intervals, the motor is energized to drive one revolution, which will load and discharge one charge of coal.

At an end of drive shaft 90 opposite sprocket 92, a radial extension 112 of drive shaft 90 is provided for reciprocally moving poker bar 110. Bar 110 and radial extension 112 are pivotally connected at connection 114 such that extension 112 is free to move in a 360 degree arc, causing poker bar 110 to reciprocate once during a charging cycle, agitating the burning fuel. Poker bar 110 extends through slot 116 in door 22, and is mounted eccentrically to reciprocate synchronously with the rotation of shaft 90.

Bin 30 and the drive mechanism therefor are preferably mounted for easy removal from furnace 20. As shown in FIG. 1, a vertical supporting stucture 78 can be provided with jack-type, length-extensible support sections or legs, at either end of a post 76. One leg bears against the ceiling, and the other against the floor, to provide a rigid support for bin 30 that allows bin 30 to rotate toward and away from furnace 20 around bar 76. The latch mechanism 24 is used to affix bin 30 in its forward, operating position. Therefore, in order to tend the fire, the user need only lift latch 24 and rotate the whole bin 30 around vertical support pipe 76, to gain full access to the door to the combustion area in the same manner as the user would have opened door 22 on its hinges. It will be appreciated that the door originally provided on furnace 20 is preferably used, but may be replaced with a similarly-dimensioned portion rigidly attached to the stoker device. To prevent operation of the stoker when the device is opened to service the fire, the user can visually check the next triggering point on the timer, or, if desired, an over-ride switch may be used.

Figure 4:
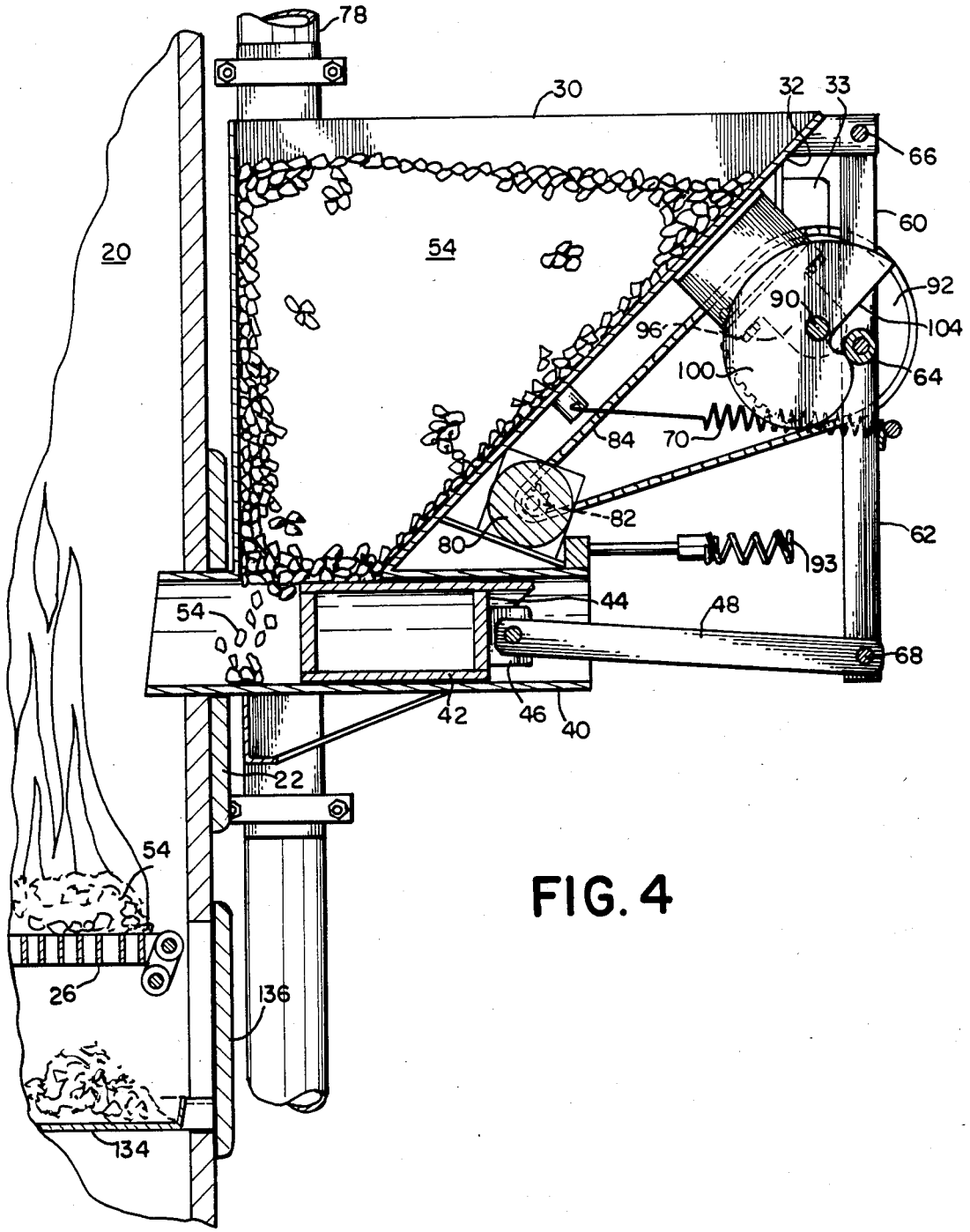
FIG. 4 is a partial section view taken along lines 4—4 in FIG. 1 being shown at commencement of a loading cycle.

As shown in FIG. 4 in section, a quantity of the coal 54 carried in the bin drops into chamber 40 when piston 42 is retracted. The coal 54 in the bin merely falls by force of gravity into the space formerly occupied by piston 42 as the piston is retracted toward the right in FIG. 4. Piston 42 may be a hollow tube having a flat faces 44 capping its ends and forming a cylinder, the tube preventing coal from falling behind face 44 when the piston is advanced. The rear side of the cylinder is provided with a pivotal attachment for linkage member 48, the linkage member attaching support bar 60 to piston 42 at one end of bar 60, namely, at pivot pin 68. The opposite end of support 60 is also attached by means of a pivot pin, to an upper part of the bin, for example a protruding flange having pivot pin 66 therein.

Upon timed initiation of a cycle, rotation of motor 80 rotates drive shaft 90 by means of sprocket 82, chain 84 and sprocket 92. The rotation is counter clockwise as shown in FIG. 4, causing spiral cam 100 to force support bar 60 farther and farther away from the furnace 20 over time as the spiral cam rotates under roller 64. During this time, the tension applied to spring 70 increases. Eventually, roller 64 comes to drop off 104, allowing piston 42 and support 60 to advance suddenly, flinging coal 54 from chamber 40 onto the fuel support structure 26 in furnace 20. The sudden release of energy to load fuel 54 into furnace 20 causes the fuel to disperse. Insofar as the fuel is repeatedly placed in the same areas or becomes coked, operation of poker member 110 agitates the fuel, and spreads it around. Poker 110 is eccentrically mounted on shaft 90 and slides inwardly through a slot 116 in door 22 during a cycle. Poker 110 is angularly disposed relative to cam 100 such that the poker is retracted between cycles, i.e., when the piston is advanced. Poker 110 agitates the coal and removes ash by abrading the pieces of fuel against one another during retraction of the piston.

Figure 3:
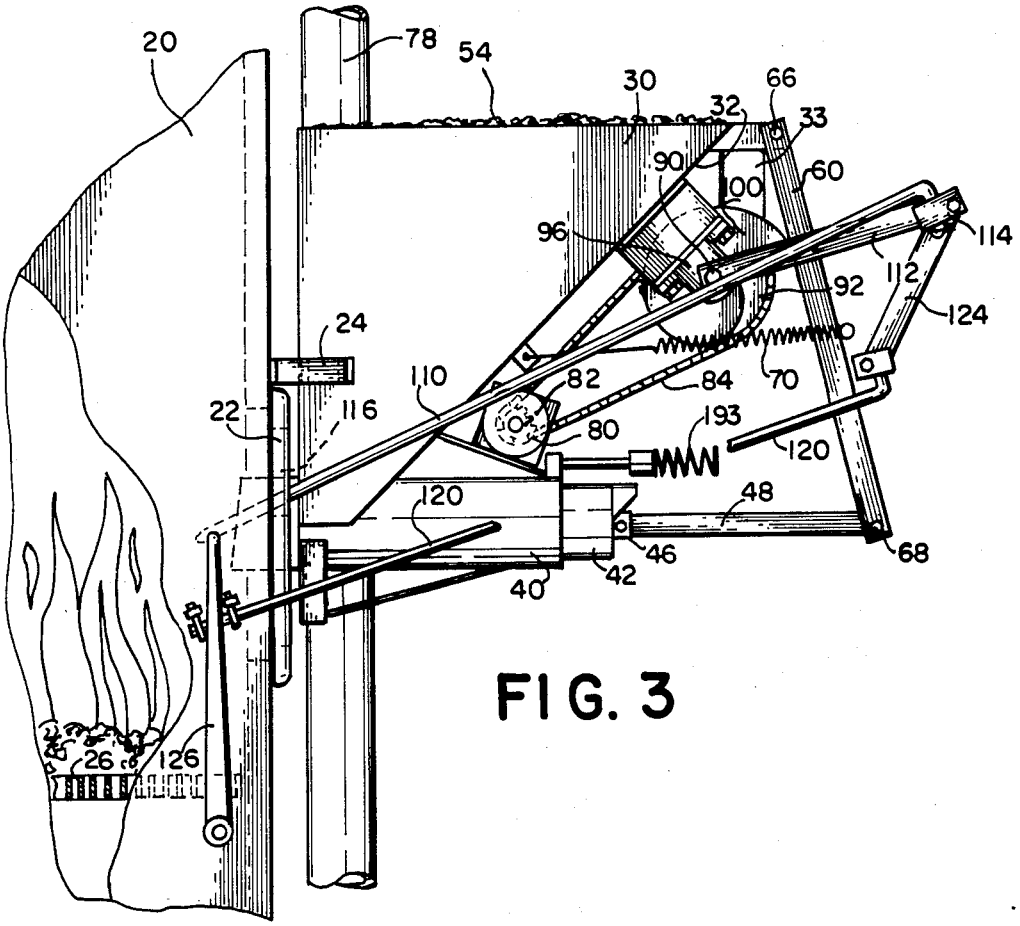
FIG. 3 is a side elevation view of the device, during cycling, at full piston retraction, portions of the furnace being shown cutaway.
Figure 5:
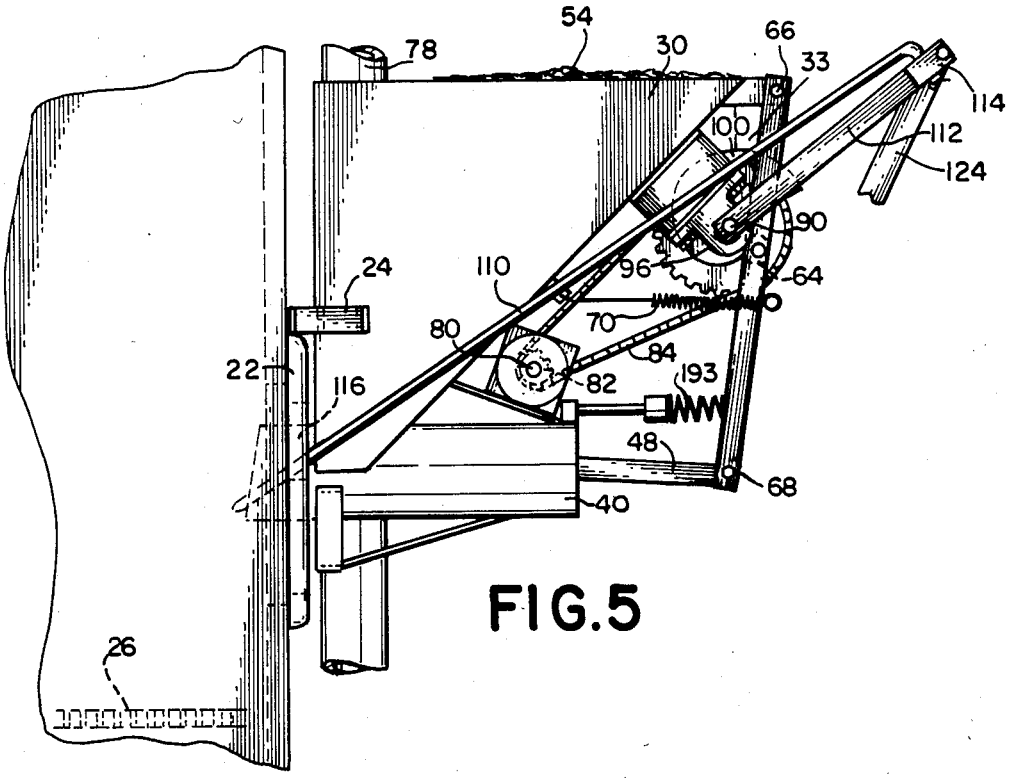
FIG. 5 is a side elevation view of the device at its idle or home position.

Fuel and ash support 26, can be manually agitated by means of a shaker handle 126 (FIG. 3) to remove ash, thus improving combustion. Fuel and ash grate 26 can also be made movable by means of the shaker handle 126, using an eccentric connection to drive shaft 90. An additional linkage is defined by pivotally-connected handle 126, linkage elements 120, 124 and radial extension 112 of drive shaft 90, which causes the fuel and ash supporting grate 26 to shake during cycling. This shaking action of the fuel support mechanism causes ash to fall through grate 26, into a catch tray 134. Tray 134 (seen in FIG. 4) can be removed through access opening 136, which is not blocked by the stoker of the invention.

Bin 30 need not be particularly large or heavy in order to store an adequate charge of coal. Approximately 3.5 cubic feet is an adequate supply. Bin 30 must be strong enough, however, to withstand the force of agitation of the fire by poker bar 110 and retraction and release of spring 70. A resilient rubber pad or a compression spring 193 is provided as shown in FIG. 4 at the innermost point on the stroke of bar 60, in order to prevent damage to the unit and/or undue noise when a load of coal is discharged. It is presently preferred that bin 30 be made of eighth inch plate steel to which a four inch pipe is welded to define discharge opening 40. A three and one-half inch pipe having plugged ends functions as the piston.

Motor 80 is a shaded-pole induction motor, internally geared down to approximately 13.5 rpm. The required power rating depends on the length of radial extension 112 and length of poker bar 110, and a 0.2 HP motor is adequate.

The motor is powered through the timer, and also through a limit switch mounted to open the circuit at the extreme inward position of the stroke. The limit switch can be mounted, for example, to operate on contact with a protrusion such as a screw on the side of sprocket 92 (see FIG. 2). The timer sets the cycle into motion. The timer engages power to the motor for about 15 seconds, during which time the limit switch is operated due to rotation of sprocket 92 thereby powering the motor in parallel to the timer. The stroke is completed after about 20 seconds by re-engagement of the limit-switch thereby opening the circuit and stopping sprocket 92 in place. The timer is bypassed by a temperature control in the furnace to insure that a cycle will not be initiated if the furnace exceeds a predetermined operating temperature. It will be appreciated that the temperature of the furnace is at least indirectly controlled by the thermostat controlling the temperature of the dwelling as well, because the thermostat in the dwelling controls release of heat from the furnace by controlling the rate of circulation of heated air or water from the furnace to the dwelling. When the dwelling reaches the desired temperature, the circulation of heat from the furnace to the house is stopped, whereupon the furnace reaches and remains at the predetermined maximum operating temperature, insuring that the temperature control in the furnace will by-pass the timer.

If the timer has already initiated a cycle to load a charge into the furnace, power is applied to the motor via the limit switch. Once initiated, the motor will run until the cycle has been completed as sensed by the limit switch. A one hour repetition, thirty second cycle timer can be used as an alternative when run through a delay switch.

The reciprocating poker bar can occasionally jam operation in mid-cycle. If the poker is forced into the grate by chunks of coking coal or if the poker is not able to break up the chunks because of pieces of rock or the like, the motor becomes stalled. By use of the aforesaid induction motor, in the event of a stall, the motor will change direction and run backwards until the limit switch is again operated, returning the device to its idle position. The device then waits until the next triggering point on the timer before making another attempt.

If the timer is still engaged even after the motor has reversed direction and backed into the limit switch, the offset in the cam makes contact with the roller, causing a jam in reverse and again reversing direction of the motor. Therefore, the device immediately makes another attempt at loading coal. This prevents any damage to the stoker or poker bar.

The various parts of the device according to the invention are preferably simple steel bars of a five-sixteenths inch or more thickness. Poker bar 110 should be a solid member of at least five eighths inch diameter, in order to survive its frequent passage into the combustion area.

As noted hereinabove, a resilient stop 193 (e.g., FIG. 4) in the form of a spring or rubber member can be provided to catch support bar 60 as spring 70 retracts. The proper positioning of this resilient catch mechanism will avoid striking roller 64 against cam 100. Durable support for drive shaft 90 is recommended, in the form of spaced pillow blocks 96. The remaining pivot connections, for example, pivot 46 at the piston, pivot 66, 68 at support bar 60 pivot 24 on latch and roller 64, and pivots 114, 124, can be made by means of suitable bolts having self-locking nuts or the like to secure the connection.

The invention having been disclosed, a number of further variations will now occur to persons skilled in the art. Reference should be made to the appended claims rather than the foregoing specification as indicating the true scope of the invention.

What is claimed is:

1. A fuel stoker for use with a furnace having a fuel support disposed behind an access port, the stoker comprising:

a fuel throwing device including an intermittently operated rotatable drive shaft, the fuel throwing device being operable to impel a charge of fuel through a discharge opening of the stoker and adapted to impel the fuel onto the fuel support, the drive shaft being mountable above the fuel support;

at least one agitator bar for breaking up coked chunks on the fuel support, removing ash from fuel in the furnace and ensuring complete burning, the agitator bar having a first end adapted to be extended into the furnace such that the first end of the agitator bar is movable over the fuel support when the agitator bar is advanced; and, a linkage eccentrically affixing an opposite end of the agitator bar to the drive shaft, the agitator bar being mountable such that the first end of the agitator bar is movable over the fuel support during the intermittent cycle of the drive shaft.

2. A fuel stoker for use with a furnace having an access port and a fuel support behind the access port, the stoker comprising:

a bin for receiving solid fuel;

a chamber disposed below the bin, the chamber having an opening into the bin and a discharge opening to be directed toward the access port, the chamber being adapted to extend just to the access port;

a spring-mounted piston disposed in the chamber and movable over as range between an advanced position blocking said opening of the chamber into the bin and a retracted position substantially clear of said opening of the chamber into the bin, the piston being spring biased toward the advanced position; and a drive means operable on an intermittent cycle for the piston, having a rotatable cam and a motor turning the cam, the piston being connected to a follower urged against the cam, the cam having a surface defining travel of the piston in said range, the cam operative to retract the piston, whereupon fuel enters the chamber from the bin due to gravity, and the cam having a discontinuous portion causing sudden release of the follower, whereupon fuel in the chamber is suddenly thrown through the discharge opening by spring biased force of the piston.

3. The stoker of claim 2, further comprising an agitator bar adapted to be extended through the access port of the furnace during an intermittent cycle of the stoker, the agitator bar being eccentrically attached by a linkage to a drive shaft of the drive means and positioned to be extendable over the fuel support during the intermittent cycle and to retract between cycles, the agitator bar being positioned such that a free end of the agitator bar is movable to break up the fuel during a cycle and retract between cycles.

4. The stoker of claim 3, wherein the motor is electric and further comprising a timer for timed initiation of a motor cycle and gear means between the motor and the drive shaft for stepping down the motor rotation rate.

5. The stoker of claim 4, wherein the motor is reversible when stalled, and further comprising at least one limit switch wired to open circuit the motor at a home position of the cam.

6. The stoker of claim 2, wherein the bin is hingeably mounted to be pivotable toward the furnace for operation and away from the furnace for access to the access port.

7. A fuel stoker, comprising:

a bin having sides converging to a bottom and an outlet passage located at the bottom, the passage having an opening directed outwardly from the bin;

a piston movably disposed in the outlet passage, advance of the piston to the opening of the outlet passage causing fuel from the bin to be pushed through the outlet passage and to fall away;

a support including a linkage for driving the piston and a spring connecting the support to the bin, the support being pivotally affixed to the piston and pivotally affixed to the bin, the support being resiliently urged toward the bin by the spring, the support being connected to a cam follower;

a drive shaft and attached cam mounted on the bin and extending under said support, the cam operative to move the cam follower and the cam defining a path over which the piston is retracted in the outlet passage, the cam having a portion defining smoothly increasing displacement around the shaft over which the cam follower retracts the piston and a stepwise drop off at which the cam follower is suddenly released; and, a motor for rotating the drive shaft and cam.

8. The fuel stoker of claim 7, further comprising pivoting means for removably attaching the stoker to a furnace having a fuel access port, the opening of the outlet passage being disposed at the fuel access port when the stoker is pivoted against the furnace.

9. The fuel stoker of claim 8, wherein said means for attaching includes a hingeable support for the bin and a furnace door attached to the bin, and fittable against the furnace.

10. The fuel stoker of claim 9, wherein the door has a slot and further comprising an agitator bar driven by the drive shaft, one end of the agitator bar being eccentrically fixed to the drive shaft, and an opposite end of the agitator bar being movable through a combustion area of the furnace.

11. The fuel stoker of claim 10, wherein the drive shaft extends past a side of the bin and further comprising a radially-directed extension of the drive shaft, the agitator bar being pivotally affixed to the radial extension for reciprocating the agitator bar through the slot.

12. The fuel stoker of claim 9, further comprising a second agitator bar and linkage connecting the second agitator bar to the drive shaft, the second bar, linkage and drive shaft being pivotally connected to one another, and the second agitator bar being adapted for connection to a movable shaker grate of the furnace.

13. The fuel support of claim 7, wherein the support has a pair of spaced parallel bars, the bars being pivotally attached to the bin at one end, pivotally attached to the piston linkage at an opposite end and having a roller located intermediate the ends for resting against the cam.

14. The fuel stoker of claim 7, further comprising a temperature sensor attachable to the furnace, and a timer control on the fuel stoker, the control being responsive to the temperaure sensor to control the number of revolutions of the drive shaft during a given time peiod.

15. The fuel stoker of claim 7, wherein said fuel passage is level.

16. The fuel stoker of claim 7, wherein the cam follower presses radially against the cam and the cam defines a spiral of continuously increasing radius as a function of angular displacement around the cam and a stepwise decrease in radius causing sudden release of the cam follower.

17. The fuel stoker of claim 7, further comprising a timer operative to initiate cycling of the stoker, the timer intermittently applying power to the motor for a period shorter than a normal cycling period of the stoker, and a limit switch wired in parallel with the timer, the limit switch being mounted to energize the motor when the stoker cycles off a home position thereof.

18. The fuel stoker of claim 17, wherein the motor is reversible upon stalling.

* * * * *